10/15/85 XR 4,547,391

United States Patent [19]

Jenkins

[11] Patent Number: 4,547,391

[45] Date of Patent: Oct. 15, 1985

[54] ARC DEPOSITION OF METAL ONTO A SUBSTRATE

[75] Inventor: Walter N. Jenkins, Swansea, Wales

[73] Assignee: National Research Development Corporation, London, England

[21] Appl. No.: 612,125

[22] Filed: May 21, 1984

[30] Foreign Application Priority Data

Jun. 3, 1983 [GB] United Kingdom ..... 8315308

[51] Int. Cl.[4] ..... B05D 1/02

[52] U.S. Cl. ..... 427/37; 219/76.14; 219/76.15; 219/121 R

[58] Field of Search ..... 427/37; 219/69 R, 76.14, 219/76.15, 121 R

[56] References Cited

U.S. PATENT DOCUMENTS 4,027,135 5/1977 Barger ..... 219/76.14

FOREIGN PATENT DOCUMENTS 745093 7/1970 Belgium ..... 219/76.14
326224 9/1920 Fed. Rep. of Germany ..... 427/37
1216648 5/1966 Fed. Rep. of Germany ..... 427/37

*Primary Examiner*—John H. Newsome
*Attorney, Agent, or Firm*—Cushman, Darby & Cushman

[57] ABSTRACT

Metal from strip feedstock 3 is arc-deposited onto a substrate 1, being propelled when molten by a gas curtain from a slit 13. The feedstock 3 is melted in regular fashion by an arc 11 struck between it and a helical non-consumable electrode 9 rotated on its axis, which is parallel to the leading edge of the feedstock 3. As the electrode 9 rotates, the arc 11 must move along the helix to keep its shortest path, and hence is constrained to traverse the full width of the feedstock 3 repetitiously.

9 Claims, 1 Drawing Figure

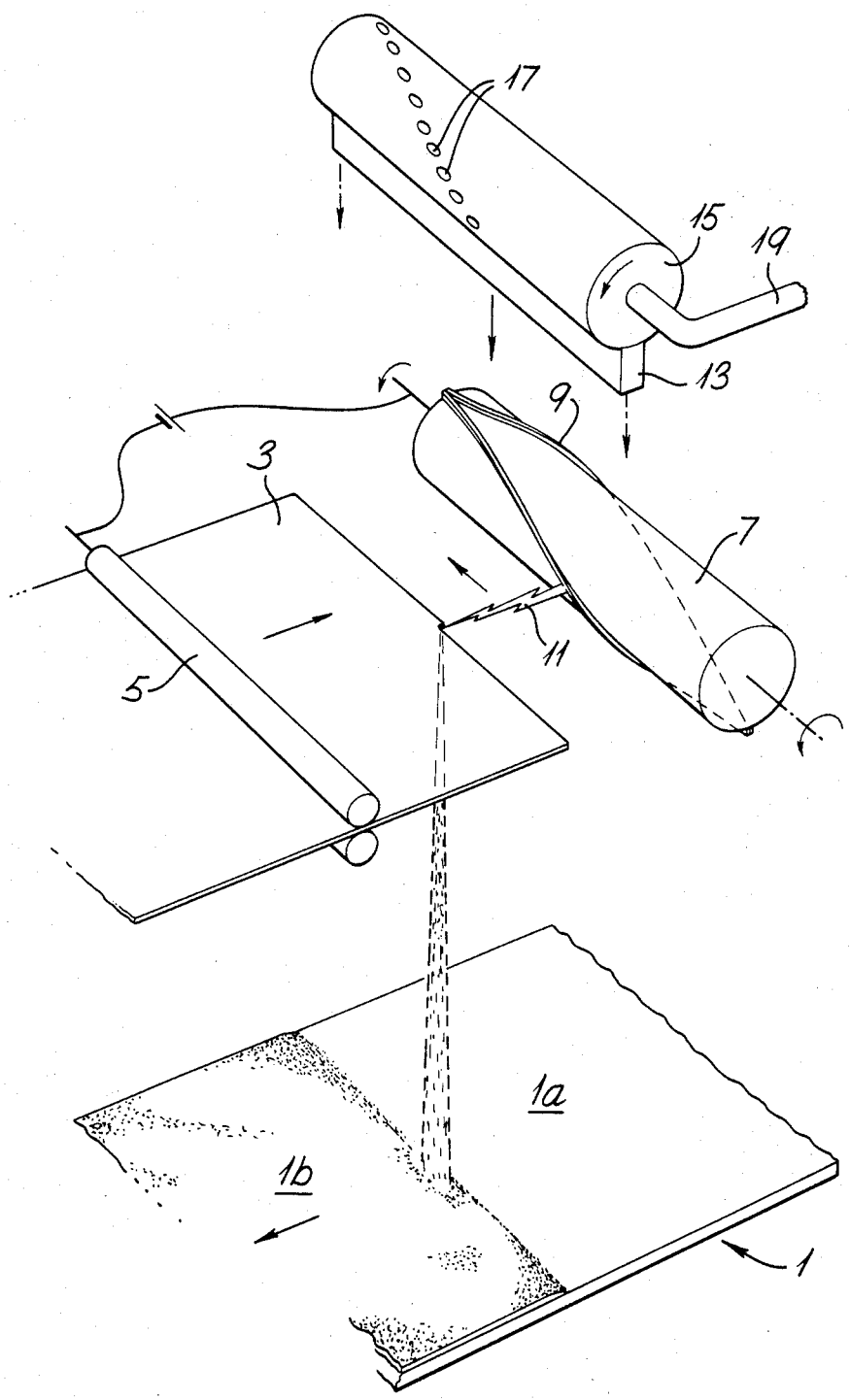
17
15
19
13
9
3
7
11
5
1a
1b
1

ARC DEPOSITION OF METAL ONTO A SUBSTRATE

This invention relates to arc deposition of metal onto a substrate. This may be for the purpose of coating the substrate, or possibly for depositing a layer which is to be stripped from the substrate.

Arc deposition of metal is commonly practised using wire feedstock. An arc is struck between two feedstock wires causing the wire to melt. A gas blast directs the metal, as it melts, onto a substrate on which the metal is to be deposited. A problem with this is that if the substrate is of any substantial width, it is difficult to ensure an even deposition over that width.

According to this invention, a method of depositing a metal on a substrate comprises striking an arc between a non-consumable electrode and a metal feedstock which is advanced towards the non-consumable electrode and propelling molten metal formed from the feedstock towards the substrate, characterised in that the feedstock is a strip.

Also according to the invention, apparatus for arc-depositing metal onto a substrate comprises a non-consumable electrode, means for advancing a feedstock of strip configuration towards the non-consumable electrode, means for applying a voltage (for striking an arc) between the strip and the electrode, and means for propelling molten metal from the strip.

The arc may be constrained to traverse repetitiously the whole leading edge of the feedstock strip, preferably at a rate of traversal which is large compared with the speed of advance of the feedstock strip. To achieve this, the non-consumable electrode could for example comprise an array of selectively chargeable members arrayed parallel to and close to the said leading edge, but preferably it is in the form of a helix whose axis is parallel to the said leading edge, the electrode being rotated about its axis, whereby the arc moves along the helix to keep the shortest helix/leading-edge path, whereby the arc traverses the leading edge. In order to ensure that it does so repetitiously, the helix may be of such a pitch as to turn through part only of a revolution in each traverse of the axial length of the notional surface of revolution (e.g. right circular cylinder) on whose surface it is formed, returning with a helix of opposite hand, the helices (of which there may be 2, 4, 6 . . . ) forming an endless loop configuration for the non-consumable electrode. The helices of opposing hands may be of identical pitch, each turning through an even fraction (i.e. $\frac{1}{2}$, $\frac{1}{4}$, 1/6 . . . ) of a revolution in each said traverse. This helical non-consumable electrode may comprise a conductor, for example of tungsten, mounted in (and preferably standing proud of) a non-conductive (e.g. ceramic) volume of revolution (e.g. cylinder), the volume of revolution being subtantially co-incident with the notional one on which the helix is formed.

The means for propelling the molten metal towards the substrate may be a gas jet or curtain. To conserve gas, gas may be supplied to only a portion of the leading edge at a time, but covering the whole leading edge at a rate which is fast compared with the speed of advance of the feedstock strip. The supply of gas may be synchronous with the traversal by the arc, may have a constant phase displacement, or may be asynchronous. Alternatively the gas can be supplied intermittently (for example as a shock wave) over the full width of the leading edge of the feedstock strip. Alternatively again, a detonation gun could be used.

The speed of advance of the feedstock may be controlled in response to the magnitude of the arc current, this magnitude being a good indicator of the arc length; as the arc gap diminishes, the current (at constant voltage) rises, and this can be used as a signal to the speed controller to slow down the advance of the feedstock, with correspondingly, a falling current being the signal to speed up the advance.

The invention extends to include a substrate on which metal has been deposited as set forth above.

The invention will now be described by way of example with reference to the accompanying drawing, which shows schematically an apparatus which is arc-depositing metal onto a substrate, according to the invention. The drawing is not to scale, and, in particular, the gaps between the various components are greatly exaggerated, for clarity.

A substrate 1 to be coated (a steel strip 250 mm wide) is advanced at a speed of 10 m per minute through a nitrogen/hydrogen chamber at 900° C. and allowed to cool to 300° C. all in nitrogen. The as yet uncoated part of the substrate 1 is shown as 1*a*, and the coated part as 1*b*. After coating, the substrate may be cross-rolled or planish-rolled, or the coating may be stripped, or any other desired operation may be performed.

The coating material (e.g. aluminum) is supplied in the form of a $\frac{1}{2}$ mm thick feedstock strip 3 which is advanced between conductive pinch rolls 5 at a speed of 1 mm/sec. The feedstock strip 3 is 250 mm wide and is advanced radially towards an alumina cylinder 7 also 250 mm in axial length and 600 mm in diameter. The cylinder 7 carries a tungsten conductor 9 let into the cylinder surface and standing 3 mm proud. The conductor 9 is in two mirror-image helical parts, each of such a pitch as to go round half the circumference of the cylinder in one traverse of its axial length; the two parts form an endless loop.

The rollers 5 and the conductor 9 are connected to opposite poles of a direct current source maintained at a potential of 30 volts. When the feedstock strip 3 is advanced to within a millimeter or less of the conductor 9 an arc 11 is struck and is arranged (as will be described) to consume 200 amps. The cylinder 7 is rotated on its axis at 3000 rpm. In order to keep its shortest possible path, the arc moves along the helix to stay as close as possible to the strip 3. Thus, it is made to traverse the leading edge of the strip 3, melting it away (as shown, exaggerated). Its traversals are regular and repetitious. The conductor 9 is not consumed.

The mechanism for advancing the strip 3 is arranged to speed up when the arc current drops below 200 amps and to slow down when the arc current rises above 200 amps.

To direct the molten part of the leading edge of the strip 3 onto the substrate 1, a gas (nitrogen) curtain is applied at a pressure of 100 psi (7 kg/cm$^2$) through a guide slit 0.4 mm wide and 250 mm long, shown as 13. To conserve gas (and pumping energy), gas is not pumped across the full length of the slit 13 all the time, but a 25 mm-long portion is active at any instant, this portion traversing the length repetitiously. Highly diagrammatic means for achieving this are shown as a hollow cylinder 15, mechanically synchronised with the cylinder 7, carrying gas slots 17 in the same helical pattern as the conductor 9. The cylinder 15 is mounted inside a sleeve (not shown) and nitrogen pumped through a pipe 19 through a rotary seal into the cylinder 15 can leave only through those slots 17 for the moment in register with the slit 13.

The slit 13 is directed tangentially to the cylinder 7, as close as possible to it without causing arc earthing problems, in practice 10–15 mm away, measured along the tangent. The substrate 1 need not be especially close, a molten metal flight path of 10–12 cm being acceptable.

I claim:

1. A method of depositing metal on a substrate comprising the steps:

striking an arc between a non-consumable electrode and a strip-shaped metal feedstock to form molten metal;

advancing said feedstock strip toward said non-consumable electrode at a given speed;

repetitiously traversing said arc the length of a leading edge of said feedstock strip at a rate greater than said advancing speed; and propelling, by gas jet or curtain, said molten metal toward said substrate, wherein said gas is supplied to only a portion of said leading edge at a time, but covering the whole leading edge at a rate which is faster than said speed of advance of said feedstock strip.

2. A method according to claim 1, wherein the supply of gas is synchronous with the traversal by the arc, or has a constant phase displacement, or is asynchronous.

3. A method of depositing metal on a substrate comprising the steps:

striking an arc between a non-consumable electrode and a strip-shaped metal feedstock to form molten metal;

advancing said feedstock strip toward said non-consumable electrode at a given speed; and propelling said molten metal toward said substrate, wherein said speed of advance of said feedstock strip is controlled in response to the magnitude of the arc current.

4. Apparatus for arc-depositing metal onto a substrate, comprising:

a non-consumable electrode;

means for advancing a strip-shaped metal feedstock toward said non-consumable electrode;

means for applying a voltage between said non-consumable electrode and said feedstock strip so as to strike an arc between same causing molten metal to be formed from said feedstock strip;

means for propelling said molten metal toward said substrate; and means for constraining said arc to traverse repetitiously the length of a leading edge of said feedstock strip, wherein said constraining means includes helix means rotatable on its axis, said axis being parallel to a plane which said means for advancing said feedstock strip cause said feedstock strip to occupy, said helix means being the non-consumable electrode.

5. Apparatus according to claim 4, wherein said helix means includes two helical parts, a first helical part being of such a pitch as to turn through only a part of a revolution in each traverse of the axial length of the notional surface of revolution on whose surface said helix means is formed, the other helical part being of opposite hand relative to said first helical part and returning to said first helical part to form an endless loop configuration for said non-consumable electrode.

6. Apparatus according to claim 5, wherein the said helical parts of opposing hands are of identical pitch, each turning through an even fraction (i.e. $\frac{1}{2}$, $\frac{1}{4}$, 1/6 . . . ) of a revolution in each said traverse.

7. Apparatus according to claim 4, wherein said non-consumable electrode includes a conductor mounted in a non-conductive volume of revolution substantially coincident with a notional volume on which said helix is formed.

8. Apparatus according to claim 4, wherein said means for propelling molten metal is a gas jet or curtain.

9. Apparatus for arc-depositing metal onto a substrate, comprising:

a non-consumable electrode;

means for advancing a strip-shaped metal feedstock toward said non-consumable electrode;

means for applying a voltage between said non-consumable electrode and said feedstock strip so as to strike an arc between same causing molten metal to be formed from said feedstock strip;

means for propelling said molten metal toward said substrate, and controller means for controlling the speed of advance of said feedstock strip, said controller means being arranged to slow said speed when the arc current rises and to raise the speed when said arc current lowers.

* * * * *